United States Patent [19]

Olsen et al.

[11] Patent Number: 4,543,070

[45] Date of Patent: Sep. 24, 1985

[54] LINKED-SPAR MOTION-COMPENSATED LIFTING SYSTEM

[75] Inventors: Ralph A. Olsen; Robert H. Cuthbertson, both of Santa Barbara, Calif.

[73] Assignee: The United States of America as represented by the Secretary of the Navy, Washington, D.C.

[21] Appl. No.: 657,641

[22] Filed: Oct. 4, 1984

[51] Int. Cl.[4] ..... B63B 21/52

[52] U.S. Cl. ..... 441/5; 114/230

[58] Field of Search ..... 114/230, 51; 414/137–140, 143; 212/146, 190, 191, 195; 441/3–5, 29

[56] References Cited

U.S. PATENT DOCUMENTS 2,572,165 10/1951 Locki ..... 212/146

4,280,430 7/1981 Wilson et al. ..... 441/3

*Primary Examiner*—Jesus D. Sotelo

*Attorney, Agent, or Firm*—Robert F. Beers; Joseph M. St. Amand

[57] ABSTRACT

An improved system for operating a lifting cable over the side of a ship at sea in which a spar buoy having an adjustable lifting capacity is coupled to the ship by a rigid linkage which is free to pivot on an axis attached to the ship deck, and operates to decouple the motion of the ship from the lifting cable. The spar buoy is attached to a gimbal sheave assembly having a disengageable connector and tension line for drawing the connector into engagement with a mating socket at the outward end of a linkage boom. A narrow upper section of the spar buoy is provided with a plurality of vertical tubes and valves which by flooding or evacuating operate to vary the effective water plane area of the buoy for continual fine tuning and optimally adjusting of its natural heave mode characteristic frequency.

10 Claims, 11 Drawing Figures

35
36
48
40
17
12
10
14
23
LIFTING CABLE
29
27
26
20
27
28
28
34
24
25
PIVOT
16
HAND WINCH 50
54
20
57
55
DECK WINCH ACTS AS COUNTERBALANCE WEIGHT 35
12
14
22
2 FT
23
8 FT SIGNIFICANT WAVE HEIGHT (LOWER SEA STATE 5)
MEAN WATER LINE 34
57
54
16
10 FT
VERTICAL MOTION OF WORKBOAT STERN (20 FT PEAK-TO-PEAK)

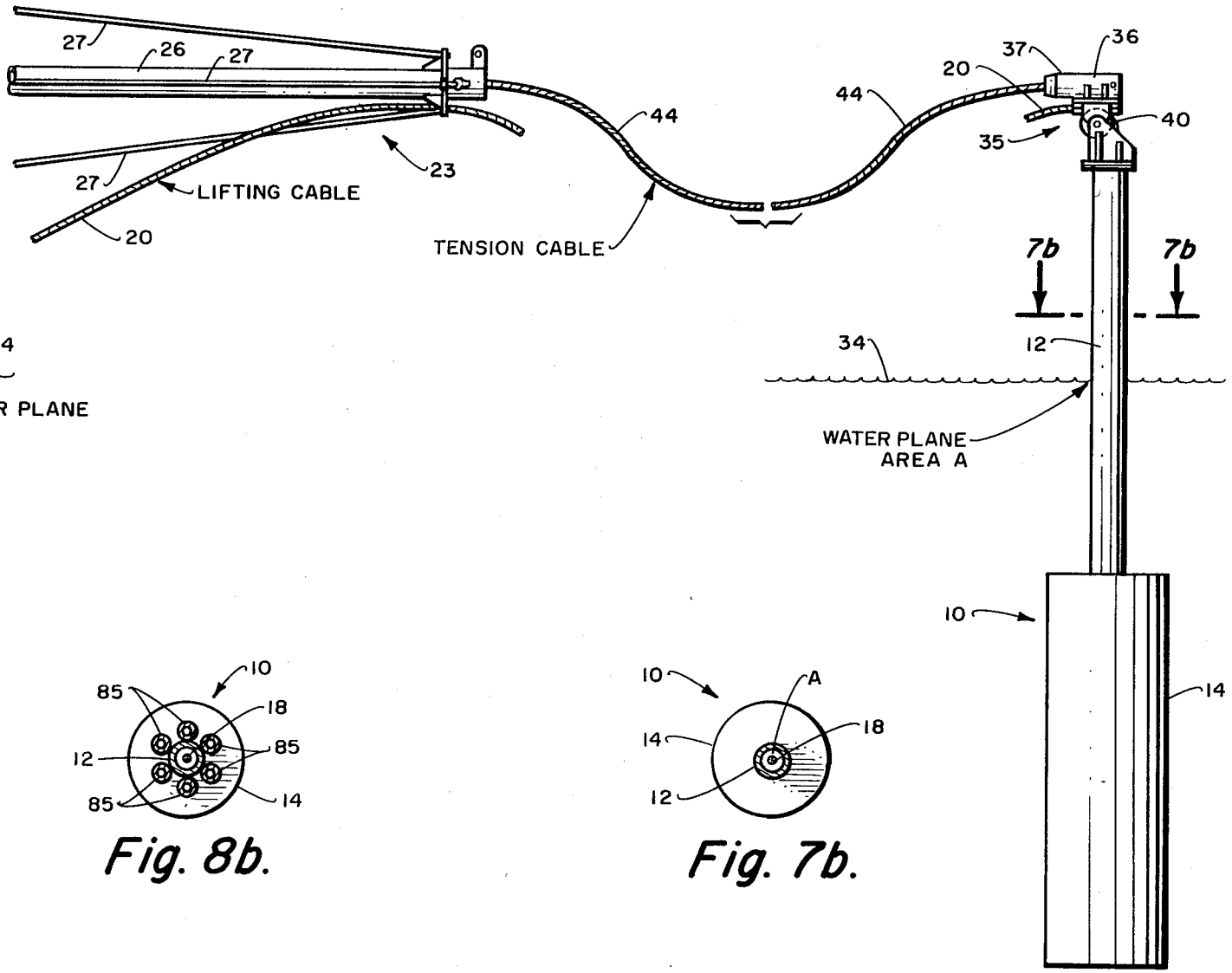
Fig. 7a.
Fig. 7b.
Fig. 8b.
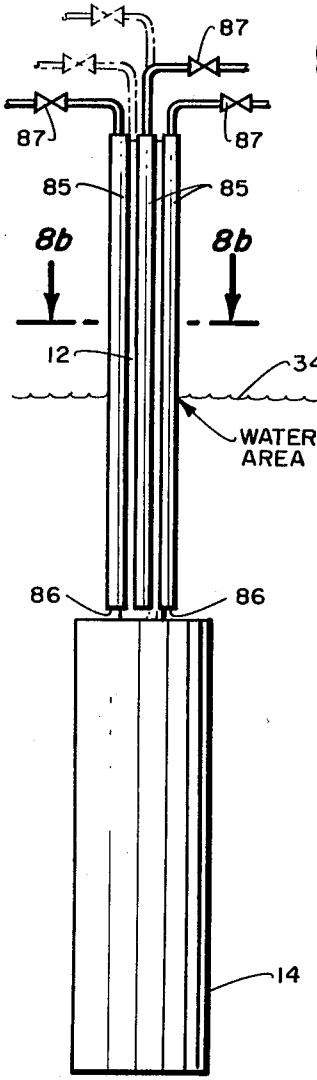
Fig. 8a.

LINKED-SPAR MOTION-COMPENSATED LIFTING SYSTEM

BACKGROUND OF THE INVENTION

This invention relates generally to the handling of objects over the side of a ship at sea and, more particularly, to an improved deck handling system in which the motion of a surface support ship is isolated from a payload suspended in the ocean by a lifting cable.

The handling of objects over the side of the ship at sea is historically a difficult problem. The motion of the ship can induce large dynamic loads on the lift line and parting of lines during operations such as salvage recovery, undersea work vehicle operations and even basic moorings is not uncommon. Deck handling systems having active or passive motion compensation have been built but these have always involved great expense and usually provided poor reliability. The devices are very complicated mechanically and require a major modification to the ship to provide proper footings for them. They usually include a motion-damped over-the-side boom with the lift line winch or at least a traction unit mounted directly on the device, which must swivel and be capable of locking to allow handling the load over the side. By their nature they have very close, definite limits on their vertical travel. They are essentially fixed installations on the ship and are not easily disassembled for transfer to other vessels or for air shipment to various parts of the world. A similar technology exists in the many motion-compensation and tension-limiting systems used by the oil industry for drill strings, but these systems are not directly applicable to over-the-side handling. Partial solution to this difficult problem has been provided in the Linked-Spar Motion-Compensated Lifting System disclosed in U.S. Pat. No. 4,280,430 issued July 28, 1981. Nevertheless, some problems in connecting and non-destructively disconnecting the payload and its supporting buoy as well as limitations in isolating motion of the ship from the payload due to changing sea conditions have continued.

SUMMARY OF THE INVENTION

Requirements of deep ocean work continue to press for increased vehicle size, heavier/larger cables, and more sophisticated deep ocean salvage. Thus, constant improvements become necessary to have a system applicable to a variety of tasks and which operates in sea states up to four or five with a capability to support a payload and survive temporary excursions past these limits without catastrophic results.

It is, therefore, an object of the present invention to increase the isolation of the motion of a surface support vessel from a payload suspended in the ocean by a lifting cable.

Another object of the present invention is to provide an over-the-side lifting system which further reduces unwanted vertical displacements and vertical velocities in the suspended payload.

Another object of the present invention is to provide an improved means for handling a payload from the deck of a ship into the water and back again.

A further object of the present invention is to provide an inherently stable system to support a payload just below the surface during any operation to be performed prior to lowering or after recovering the payload before it is brought aboard or otherwise transferred for shipping.

A further object of this invention is to provide an over-the-side lifting system which has an ability to connect and disconnect the payload supporting buoy from a linked spar with the spar in the generally horizontal or deployed position.

Another object of this invention is to provide a unique connect and disconnect capability to make the system useful for handling a variety of loads which because of their shape and configuration cannot be lifted aboard or launched from the working platform from which the system is installed, and which permits connection of a payload supporting buoy to the load in the water at a remote location and then movement of the buoy to the linked spar for engagement with the link.

Another object is to provide an easy-to-operate remotely controlled means of bringing a separated load and support buoy into positive connection with a linked spar and similarly for accomplishing disconnection by remote control.

Another object is to provide a means of rapidly and nondestructively disconnecting a load and buoy from a linked spar in the event of an operating emergency condition.

Another object is to provide a simple means for changing the natural heave mode characteristic frequency of a spar buoy to further decouple the spar buoy and load from prevailing sea conditions.

Yet another object is to provide an improved motion compensated lifting-system which permits continuing and optimal adjustment of heave mode characteristics in changing sea conditions for maximal decoupling effect.

In the linked-spar system of this invention a payload is suspended by a lifting cable passing over a sheave mounted in a first yoke which forms part of a gimbal sheave assembly. A second yoke is mounted on the top of a spar buoy and is free to pivot on the same axis as the sheave in the first yoke. The spar buoy has a central longitudinal channel allowing the lifting cable to pass through a thin, water-surface-penetrating upper section and a large, submerged base section. The lifting capacity of the spar buoy is adjustable so that only the upper section penetrates the water's surface and the base section remains submerged as the load which must be supported varies. In addition, a narrow upper section of the spar buoy is provided with a plurality of vertical tubes and valves which by flooding or evacuating operate to vary the effective water plane area of the buoy for continual fine tuning and optimally adjusting of its natural heave mode characteristic frequency. The pivot axis of the second yoke is normal to the longitudinal channel of the spar buoy. The gimbal sheave assembly is disengageably mounted at the end of a rigid boom which is attached to the deck of a surface vessel and free to pivot on an axis (deck axis) parallel to the deck of the vessel. The boom is joined to the gimbal sheave assembly by a male/female connector and an engagement line attached to a small winch, which operates to hold the male/female connector together when the engagement line is pulled in tension. The lifting cable is fed from a winch, located at the inboard end of the boom on the vessel, to the gimbal sheave which is mounted so that the lifting cable falls into the longitudinal channel of the spar buoy. The arrangement decouples vessel's pitch and roll from the lifting cable with the result that the vertical motion of the lifting cable other than that due to the intake and outtake of the cable is controlled exclusively by the motion of the spar which is itself highly decoupled from the motion of surface waves.

Other advantages and features of the present invention will be readily appreciated as the subject invention becomes better understood by reference to the following detailed description, when considered in conjunction with the accompanying drawing.

FIG. *7a* is a side view of a normal spar buoy showing the smaller upper section in relation to the water line (water plane area), and which also illustrates use of a separate tension line in conjunction with a gimbal sheave assembly for remotely coupling/decoupling of the gimbal sheave assembly and buoy to the boom arm.

FIG. *7b* is a cross-sectional plan view of the spar buoy of FIG. *7a* taken at its water plane area.

FIG. *8a* is a side view of the spar buoy of this invention with an array of relatively small diameter long length adjustable buoyancy tubes along the side of the smaller, upper section of the spar buoy for fine tuning the spar buoy response to sea conditions.

FIG. *8b* is a cross-sectional plan view of the spar buoy of FIG. *8a* taken at its water plane area.

Figures 1, 9:
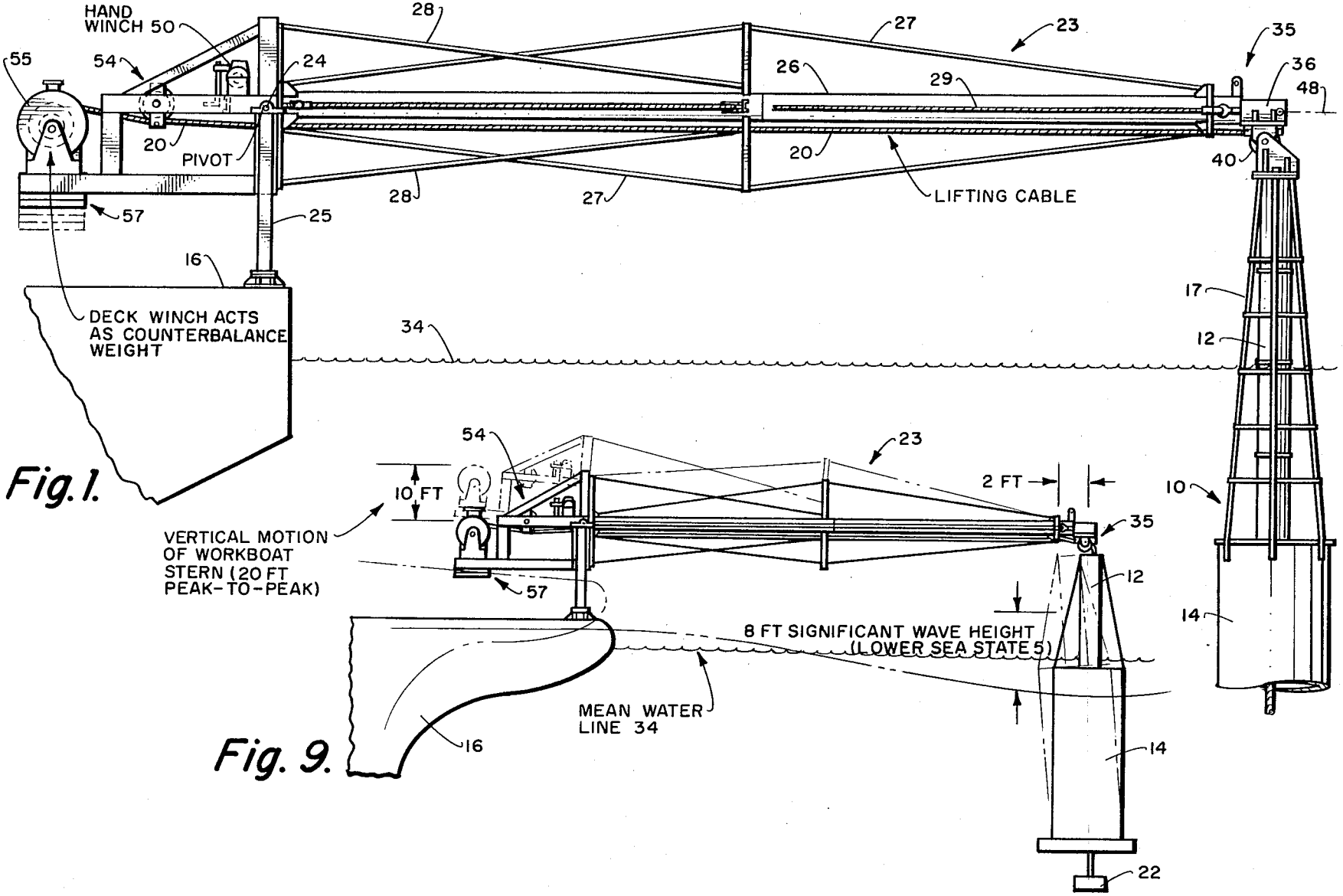
FIG. 1 is a side view illustrating an embodiment of the improved linked-spar lifting system.
Figure 2:
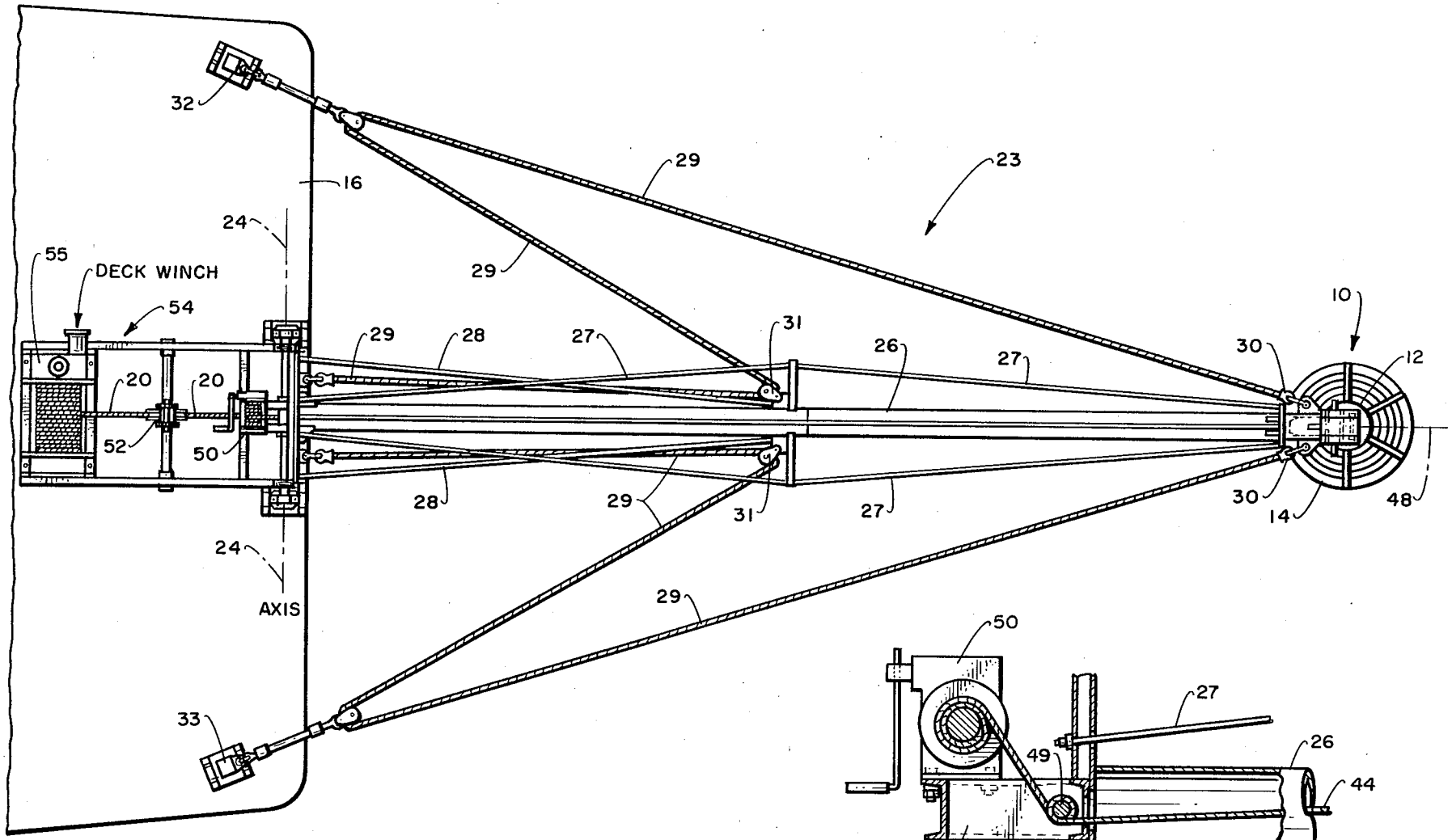
FIG. 2 is a top plan view of the linked-spar lifting system of FIG. 1.

FIG. 9 is a pictorial view illustrating the decoupling of the spar buoy from the motion of the support ship.

DESCRIPTION OF THE PREFERRED EMBODIMENT

Referring now to the drawings, wherein like reference characters designate like or corresponding parts throughout the several views, a spar buoy 10 having a hollow upper section of relatively small cross-sectional area (herinafter more fully described) and a hollow base section 14 of relatively large cross-sectional area is shown deployed over the stern of a surface support vessel such as an offshore work boat 16. A frame 17 is used to strengthen the connection of upper section 12 to base section 14 of the spar buoy and also acts as a guard for protection of section 12. The spar buoy 10 has a centrally located, longitudinal, free-flooded channel 18 that allows passage of a primary lifting cable (lift line) 20 through both the upper section 12 and the base section 14. The lifting cable 20 exits the bottom section 14 through a flared flexural strain relief 21 (see FIG. 6). A payload 22 is attached to the lifting cable 20 and supported by the buoyancy of the spar buoy 10.

The spar buoy 10 and the lifting cable 20 are connected to the support vessel 16 by a linkage system which includes a boom 23 mounted to pivot on axis 24 atop a pair of columns 25 attached to the deck of vessel 16. Boom 23 includes arm 26, lines 27, 28, 29 and associated rigging connections. Rigging lines 27 and 28 increase the rigidity of arm 28. Rigging lines 29, connected to the outer end of arm 26 at 30 and its midsection at 31, are secured by adjustable connectors to columns 32 and 33 attached to the deck of the vessel to eliminate side sway and further rigidize boom 23. However, it is noted that many other structural designs such as open trussworks and a variety of materials may be suitable for the boom. The boom 23 is located on the deck of the vessel at any selected position, preferably with the pivot axis 24 at about the same height above the mean water line 34 as the top of the spar buoy and near enough the deck edge to allow full motion of the boom on axis 24 without interference from the deck. Boom 23 may be attached to the ship either over the side, preferably amidships, or off the stern, as shown in FIGS. 1, 2, 6 and 9, depending upon the application. The boom is internally rigid and, relative to the vessel 16, free to rotate only about the pivot axis 24. A disengageable gimbal sheave assembly 35 is mounted at the outer end of boom arm 26.

Figure 5:
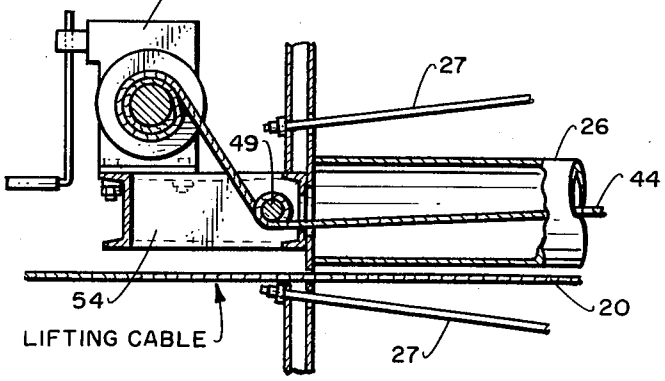
FIG. 5 is an enlarged side view showing the small winch section of the boom assembly of FIG. 1.
Figure 3:
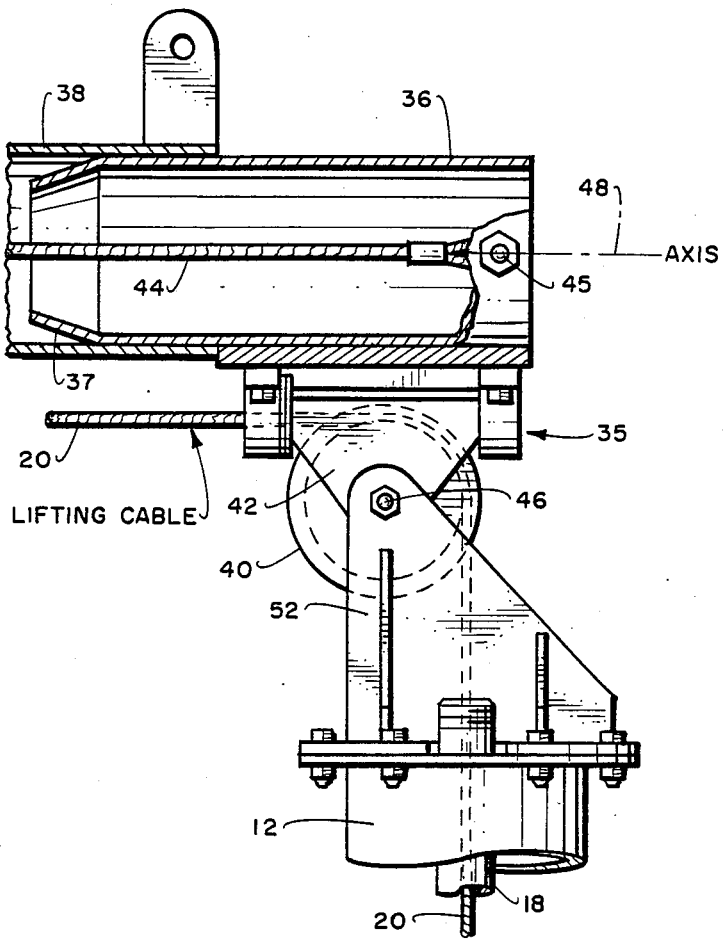
FIG. 3 is an enlarged side view of the gimbal sheave assembly shown in FIG. 1 illustrating the coupling of the linkage system to the spar buoy.
Figure 4:
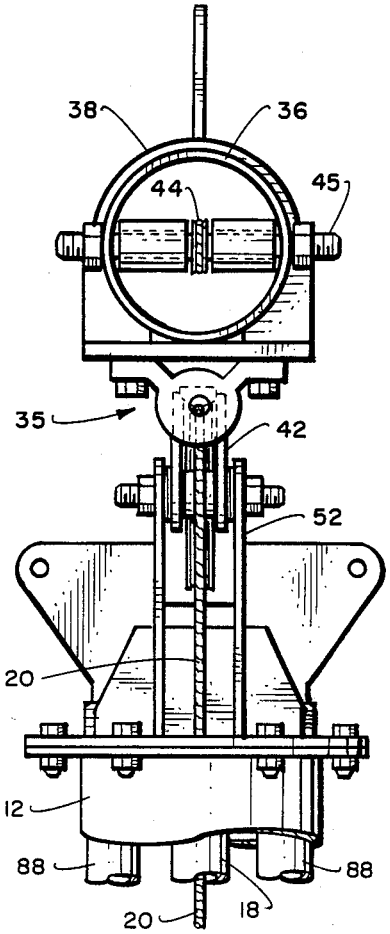
FIG. 4 is an end view of the gimbal spar assembly of FIG. 3.

As best shown in the enlarged views of FIGS. 3 and 4, gimbal sheave assembly 35 includes a connecting cylinder 36 having a male mating projection 37 which engages with female socket 38 at the outer end of boom arm 26. Sheave 40 is mounted in a first yoke 42 which in turn is attached to cylinder 36. Connecting cylinder 36 is held within female socket 38 at the end of boom arm 26 by an engagement line (cable) 44 attached to a connector bar 45, but is free to rotate on axis 48 within socket 38. Cable 44 passes through the interior of boom arm 26 under roller bar 49 near the inboard end of boom 23 and is connected to a small winch 50, as more clearly shown in FIG. 5. Engagement line 44 operated by winch 50 operates to pull the gimbal sheave assembly 35 and attached spar buoy 10 and payload into contact with and finally fully seated engagement with socket 38 at the end of boom arm 26. Maintaining tension on line 44 holds the assemblies together in a locked position, although the sheave assembly is free to rotate about axis 48. Release of tension on line 44 allows the gimbal sheave assembly 35 and buoy 10 to disengage from the boom in the event of an operating emergency condition or other situation requiring removal of the supporting platform vessel from the scene. The coupling/decoupling feature of the gimbal sheave assembly with the end of boom arm 26 allows connection of spar buoy 10 to a load in the water at a remote location and movement of the spar buoy via line 44 (see FIG. *7a*) for engagement with the end of the boom.

The spar sheave 40, which is free to rotate about its axle 46, is positioned above the spar buoy 10 such that lifting cable 20 passing over it will fall through the longitudinal channel 18. The top section 12 of the spar buoy 10 is connected by a second yoke 52 allowing it to separately pivot on axle 46 along with sheave 40. First yoke 42 is thereby free to rotate in a direction parallel to pivot axis 24 of boom 23 and also pivot in a direction parallel to the longitudinal axis of the spar.

Thus, the linkage system forms a triangle which is nominally horizontal during operations and is constrained to translate laterally with the vessel 16. In addition, the linkage decouples the vessel's roll and pitch from the spar 10 through rotation of the linkage about the axis 24 and the gimbal-like sheave coupling between the boom 23 and the spar buoy 10. The linkage system should be long enough to ensure that the ship's motion does not interact with the spar buoy. In general, a suitable length is about two to three times the maximum vertical motion of the vessel 16 at the place of attachment. Thus, the minimum required length varies according to the type of support vessel.

Lifting cable 20 passes over sheave 40, along the bottom of boom arm 26 and under deck sheave 52 mounted on frame 54 at the inboard end of boom 23. Frame 54 supports winch 50 which is used to couple or decouple gimbal sheave assembly 35 from female socket 38 at the end of boom arm 26, and also supports the main deck winch 55 to which lifting cable 20 is connected. Deck winch 55 and its cable mass are located so as to act as a counterbalance weight for boom 23. Additional dead weight 57 can be added at the rear of frame 54 for further counterbalance, as needed. The frame 54 with the winches, dead weights, boom arm 26 and rigging lines all pivot about axis 24 as a unitary assembly.

Since it is well known that the resonant period of a spar buoy's vertical motion is inversely proportional to the crosssectional area penetrating the surface and proportional to the square root of the spar buoy's in-air weight, the length of the upper section 12 is chosen in view of the maximum sea state in which the spar is intended to operate; the upper section 12 is long enough to prevent the lower section from penetrating the ocean surface due to the vertical displacement of the surface and of the spar itself due to the wave motion (although the latter is relatively small). In general, the cross-sectional area of the upper section 12 is chosen to provide as long a resonant period as possible while at the same time providing sufficient structural strength to support the loads applied horizontally and vertically through the linkage. The cross-sectional shape of the spar buoy 10 (both sections 12 and 14) is optional, although a circular cross-section is preferred for most operations because of the symmetry and ease of fabrication. In view of the low pressure differentials which will be experienced by the spar buoy 10, various cross-sectional shapes are possible, such as a square crosssection for improved packaging during shipping and easier deck handling or a faired cross-section for improved towing capabilities. Since the base section 14 does not penetrate the water's surface during deployment, the design of this section is quite flexible. The size and shape of section 14 is primarily determined by the intended payload of the system. The base section 14 must provide sufficient lift capacity for the intended payload and length (weight) of cable required. Upper section 12 (surface penetrating section) of the spar buoy may be fabricated as a sealed unit separate from base section 14 and the two sections combined when ready for deployment. This will greatly reduce the size during shipping and will allow the use of a variety of base sections (the main lifting section) with just one upper section to improve modularity and flexibility of the system.

Figure 6:
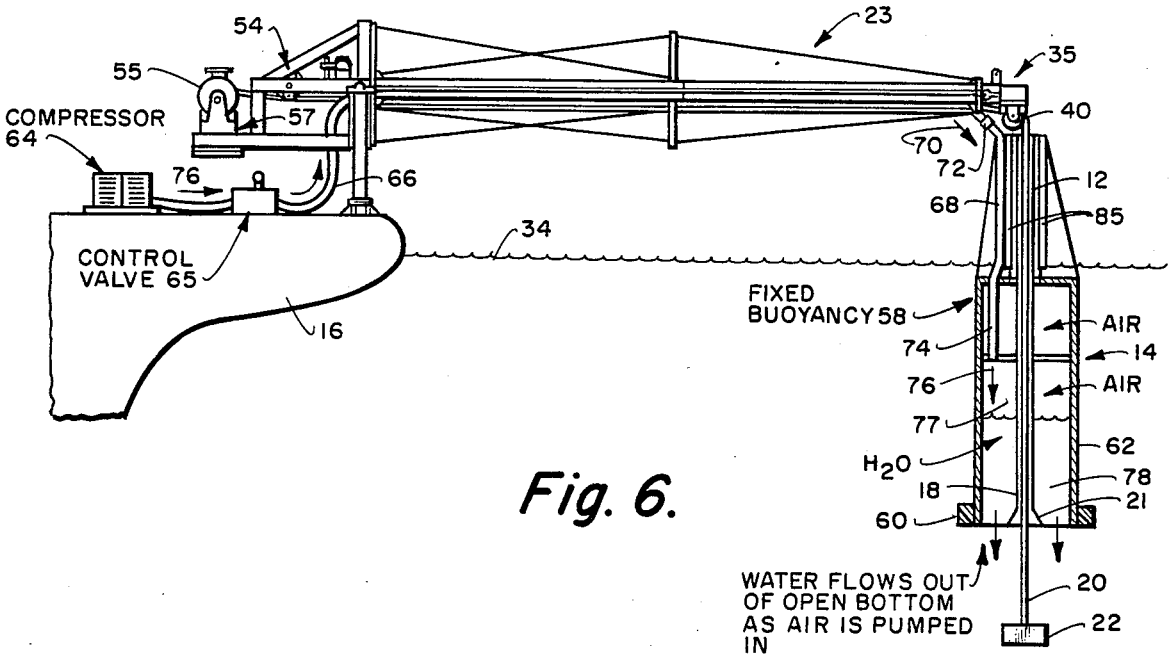
FIG. 6 is a side view of an embodiment of the present invention in which the spar buoy is shown in cross-section.

Since the effective weight which the spar buoy must support will vary, the lift capacity of the spar buoy 10 is adjustable to allow the spar buoy to float with the mean water line 34 at approximately the middle of the upper section 12. For example, the proper flotation level must normally be maintained when the spar is supporting only its own weight and also when it is supporting a load (such as the linkage, a payload, or a variable length of lifting cable). Referring now to FIG. 6, which includes a cross-sectional view of the spar buoy, a fixed buoyancy is provided by the hollow upper section 12 and a fixed buoyancy compartment 58 at the top of the base section 14 encircling the longitudinal channel 18. These cavities are sealed to provide buoyancy to support the weight of the spar itself and the linkage. A fixed ballast 60 is disposed at the bottom of the base section 14 around the perimeter to provide righting moment to stabilize spar buoy 10, especially when there is no payload attached to the lifting cable 20 and the weight of the linkage system is applied to the top of the spar buoy. The lower portion of the hollow base section 14 provides a variable ballast chamber 62 which may be watered or dewatered to provide a variable ballast for the spar. FIG. 6 illustrates a pneumatic ballast control system in which air from a shipboard compressor 64 is directed under control of control valve 65 to a first air hose 66 which passes through or along the side of the boom arm 26 to a second air hose 68 attached to the upper section 12 of the spar buoy, for example. A slack area 70 is provided in the hose path to allow for the gimbal-like motion between the outboard end of boom 23 and the gimbal sheave assembly 35 and spar buoy 10. A break-away coupling 72 may be provided where the two hoses 66 and 68 are joined. Compressed air passes via hose 68 through the fixed buoyancy compartment 58 and enters the top of variable ballast chamber 62 at air inlet/outlet 74. When it is desired to increase lift capacity, the compressed air is allowed to flow in the direction of arrows 76 to dewater chamber 62 by forcing water out of the bottom of the chamber, thereby creating an upper section 76 containing air and lower section 78 filled with water. Alternatively, when it is desired to reduce lift capacity, the air line is vented at control valve 65 and sea pressure forces water into the bottom of the spar buoy and air out via the hoses 66 and 68.

For maximal decoupling of the spar buoy 10 and load from prevailing sea conditions, a feature to permit continuing and optimal adjustment of the heave mode is provided about the narrow section 12 (i.e., upper portion) of buoy 10. Means for changing the natural heave mode characteristic frequency of spar buoy 10 is best shown in FIGS. 8*a* and 8*b*. Natural heave frequency is principally a function of the water plane area (e.g., area A of FIGS. 7*a* and 7*b*). While the water plane area can be made small to achieve frequencies generally out of the sea frequency encounter range, the small cross-sectional area A of upper section 12 of FIGS. 7*a* and 7*b* results in a sensitivity of total displacement. A slight change in load could cause the buoy floating at the normal water line to sink or to emerge excessively since reserve buoyancy is minimal. This results from the small water force. Breaking a payload loose from the bottom, for example, could result in a range of load variation beyond the ability of modest draft changes to accept. The arrangement shown in FIGS. 8*a* and 8*b* provides a means for increasing or varying the water plane area to accommodate load variations and to change the water plane area to change heave frequencies and harmonics. In FIGS. 8*a* and 8*b* a plurality of tubes or pipes 85, each open at the bottom 86 and operable to be closed with a valve means 87 at the top, surround upper section 12 of spar buoy 10. When any of upper valves 87 are open their respective pipes are freely flooded and contribute no buoyancy. Equations of motion of spar buoy depend heavily upon upper spar 12 diameter. By flooding various ones of the pipes 85 or evacuating them by air pressure via valves 87 and hoses from a compressor, the effective upper spar buoy diameter can be varied to change the water plane area and thus to fine tune the response of the buoy during operation (the control valves 87 and compressor can be located on vessel 16 similar to control valve 65 and compressor 64, shown in FIG. 6). The range of water plane areas will vary as the number of pipes 85. Shown in FIG. 4, as another example, are a pair of pipes 88 which can be valved at the top with valves, such as valves 87, and be vented to seawater at the bottom and thus be made to operate substantially the same as pipes 85 in FIGS. 8*a* and 8*b*.

The following description is directed to the operation of the linked spar system as an over-the-side handling system having passive motion compensation. Referring now to FIG. 9, a linked spar system supporting a payload 24 is shown deployed over the stern of an off-shore work boat 16. The lift capacity of the spar buoy is adjusted through use of the deballasting system so that the spar floats with the mean water line 34 being approximately at the midpoint of the upper section 12, as shown. For a significant range of sea state frequencies, the spar 10 is inherently decoupled from the surface wave action, the natural period of the spar buoy being related to the cross-sectional area of the upper section and the spar's in-air weight as previously noted. The range of water plane areas can be varied by the method shown and previously described for FIGS. 8*a* and 8*b*.

The linkage system decouples the motion of the surface support vessel 16 from the payload. In practice, the top of the spar buoy moves only a small amount (vertically), usually less than ten percent of the wave height and probably and even smaller percentage of the actual deck motion, which also includes ship's roll and pitch.

FIG. 9 illustrates the decoupling between the spar 10 (load 24) and the work boat 16, for an eight foot peak-to-peak significant wave height (lower Sea State 5) and a vertical motion of the stern of the work boat of twenty feet peak-to-peak, for example. The solid lines represent the relative means positions of the spar and the work boat and the dashed lines represent the typical displacements from the mean positions. The rotation about axis 48 decouples that ship's motion (roll in this case) which is rotational in a direction parallel to the linkage axis 24. The pivoting on axle 46 and the rotation of the linkage about axis 24 decouple the ship's pitch. The result is that the motion of cable 20 suspended from sheave 40 on top of spar buoy 10 is controlled exclusivly by the motion of the spar buoy and is decoupled from both motion of the work boat 16 and the surface wave action.

Obviously, many modifications and variations of the present invention are possible in light of the above teachings. It is therefore to be understood that within the scope of the appended claims the invention may be practiced otherwise than as specifically described.

What is claimed is:

1. An improved lifting system for operating a lifting cable over the side of a floating platform in which the pitch and roll of the platform and the motion of the water's surface are decoupled from the lifting cable, said lifting system comprising:

a. a spar buoy having a narrow upper section with a relatively small cross-sectional area and a base section of a relatively large cross-sectional area, said spar buoy having a longitudinal channel for permitting passage of the lifting cable through the spar buoy;

b. rigid boom means having an outboard end and an inboard end, said boom means being mounted to pivot forward of its inboard end on a first axis fixed relative to the deck of the floating platform to allow said boom means to rotate relative to the platform;

c. a connect/disconnect gimbal sheave assembly means having a single sheeve free to rotate on its axle being rotatably and disengagedly coupled to the outboard end of said boom means to allow said gimbal sheave assembly means to rotate about a second axis which is normal to said first axis, said gimbal sheave assembly means also being pivotably coupled to the top of said spar buoy upper section to allow said spar buoy to pivot about an axis normal to the second axis and parallel to the first axis;

d. said single sheave being positioned about said spar buoy so that a lifting cable passing over said single sheave will fall through the longitudinal channel of said spar buoy;

e. a first means disposed at the inboard end of said boom means for letting out and taking in the lifting cable, said lifting cable extending from said first means for letting out and taking in over said single sheave means and through said longitudinal channel for connection to a payload;

f. a second means disposed at the inboard end of said boom means for letting out or taking in a tension line, said tension line extending from said second means for letting out or taking in along said boom means to the outboard end thereof where it is connected to said connect/disconnect gimbal sheave assembly means; said tension line when let out allowing said gimbal sheave assembly along with said spar buoy to disengage from the end of said boom means; and g. said tension line when taken in causing said gimbal sheave assembly means and spar buoy to be pulled toward and become engagedly and rotatably coupled to the outboard end of said boom means and secured thereto when said tension line is held in tension.

2. The system as recited in claim 1 including means for varying the effective water plane area of said spar buoy upper section to change and fine tune the natural heave mode characteristic frequency of the spar buoy.

3. The system as recited in claim 2 wherein said means for varying the effective water plane area comprises:

a. A plurality of small diameter long length tubes mounted about the circumference of said narrow upper section of said spar buoy;

b. said tubes each being open to sea water at the bottom and valved at their upper ends for selectively allowing said tubes to be flooded with water.

4. The system as recited in claim 3 wherein means is provided for selectively directing air under pressure into and out of each of said tubes via said valves at their upper ends; the air pressure being increased to cause air to flow into said tubes and force water out to increase the effective water plane area of said spar buoy upper section, and being decreased to allow water to fill the tubes and decrease the effective water plane area.

5. The system as in claim 3 wherein said tubes are mounted inside said upper section of the spar buoy.

6. The system as in claim 1 wherein said gimbal sheave assembly means comprises:

a. An engagement mount having a male projection thereon for mating engagement with a generally female socket on the outboard end of said boom means; and b. said single sheave being mounted in a yoke attached to said engagement mount.

7. The system as in claim 1 wherein spar buoy pivots about said single sheave axle which is normal to said second axis and parallel to said first axis.

8. A system as in claim 1 wherein said tension line extends from said second means for letting out or taking in within the interior of said boom means to said connect/disconnect gimbal sheave assembly means.

9. A system as in claim 1 wherein said first means for letting out and taking in the lifting cable is a winch means which also operates as a counterbalance means for said boom means.

10. A system as in claim 1 wherein varying amounts of counterbalance deadweight is added to the inboard end of said boom means.

* * * * *